US007745082B2

(12) United States Patent
Belknap et al.

(10) Patent No.: US 7,745,082 B2
(45) **Date of Patent: *Jun. 29, 2010**

(54) IMAGING MEMBER

(75) Inventors: Nancy L. Belknap, Rochester, NY (US); John F. Yanus, Webster, NY (US); Dale S. Renfer, Webster, NY (US); Anthony M. Horgan, Pittsford, NY (US); Kendra M. Giza, Fowlerville, MI (US)

(73) Assignee: Xerox Corporation, Norwalk, CT (US)

( * ) Notice: Subject to any disclaimer, the term of this patent is extended or adjusted under 35 U.S.C. 154(b) by 313 days.

This patent is subject to a terminal disclaimer.

(21) Appl. No.: 11/891,116

(22) Filed: Aug. 9, 2007

(65) Prior Publication Data

US 2008/0138724 A1 Jun. 12, 2008

Related U.S. Application Data

(60) Provisional application No. 60/869,500, filed on Dec. 11, 2006.

(51) Int. Cl.
*G03G 15/16* (2006.01)

(52) U.S. Cl. ..... 430/58.75; 430/125.3

(58) Field of Classification Search ..... 430/48, 430/58.65, 58.75, 125.3
See application file for complete search history.

(56) References Cited

U.S. PATENT DOCUMENTS

| | | | | |
|---|---|---|---|---|
| 3,121,006 | A | 2/1964 | Middleton et al. | |
| 4,273,846 | A * | 6/1981 | Pai et al. | 430/58.75 |
| 4,286,033 | A | 8/1981 | Neyhart et al. | |
| 4,291,110 | A | 9/1981 | Lee | |
| 4,587,189 | A | 5/1986 | Hor et al. | |
| 6,156,468 | A | 12/2000 | Wehelie et al. | |
| 6,177,219 | B1 | 1/2001 | Yuh et al. | |
| 6,255,027 | B1 | 7/2001 | Wehelie et al. | |
| 7,005,222 | B2 | 2/2006 | Horgan et al. | |
| 7,033,714 | B2 * | 4/2006 | Horgan et al. | 430/58.3 |
| 7,166,397 | B2 * | 1/2007 | Mishra et al. | 430/58.8 |
| 2002/0076632 | A1 | 6/2002 | Yanus et al. | |
| 2007/0254226 | A1 * | 11/2007 | Yanus et al. | 430/58.75 |
| 2007/0298342 | A1 * | 12/2007 | Wu et al. | 430/58.75 |
| 2008/0032220 | A1 * | 2/2008 | Levy et al. | 430/58.65 |
| 2008/0032221 | A1 * | 2/2008 | Lin et al. | 430/58.65 |
| 2008/0057423 | A1 * | 3/2008 | Wu et al. | 430/58.2 |
| 2008/0057425 | A1 * | 3/2008 | Wu et al. | 430/58.8 |
| 2008/0107985 | A1 * | 5/2008 | Yanus et al. | 430/58.75 |

OTHER PUBLICATIONS

U.S. Appl. No. 11/820,825, filed Jun. 21, 2007, Belknap et al.

* cited by examiner

*Primary Examiner*—John L Goodrow
(74) *Attorney, Agent, or Firm*—Pillsbury Winthrop Shaw Pittman LLP

(57) ABSTRACT

A photoreceptor drum is disclosed with a charge transport layer comprising a substituted terphenyl diamine having the structure of Formula (I):

Formula (I)

wherein $R_1$ and $R_2$ are independently selected from the group consisting of hydrogen, alkyl having from 1 to 10 carbon atoms, halogen, and phenyl; and wherein at least one of $R_1$ and $R_2$ is not hydrogen.

10 Claims, 1 Drawing Sheet

IMAGING MEMBER

CROSS REFERENCE TO RELATED APPLICATIONS

This application is a non-provisional application claiming priority from U.S. Provisional Application No. 60/869,500, filed on Dec. 11, 2006, the contents of which are herein incorporated by reference in their entirety. Reference is also made to copending, commonly assigned U.S. patent Ser. No. 11/820,825 to Belknap et al., the contents of which are also herein incorporated by reference in their entirety.

BACKGROUND

The present disclosure, in various exemplary embodiments, relates generally to electrophotographic imaging members and, more specifically, to a photoreceptor drum having a charge transport layer comprising a substituted terphenyl diamine.

Electrophotographic imaging members, i.e. photoreceptors, typically include a photoconductive layer formed on an electrically conductive substrate. The photoconductive layer is an insulator in the dark so that electric charges can be retained on its surface. Upon exposure to light, the charge is dissipated.

An electrostatic latent image is formed on the photoreceptor by first uniformly depositing an electric charge over the surface of the photoconductive layer by one of the many known means in the art. The photoconductive layer functions as a charge storage capacitor with charge on its free surface and an equal charge of opposite polarity on the conductive substrate. A light image is then projected onto the photoconductive layer. The portions of the layer that are not exposed to light retain their surface charge. After development of the latent image with toner particles to form a toner image, the toner image is usually transferred to a receiving substrate, such as paper.

A photoreceptor usually comprises a supporting substrate, a charge generating layer, and a charge transport layer ("CTL"). For example, in a negative charging system, the photoconductive imaging member may comprise a supporting substrate, an electrically conductive layer, an optional charge blocking layer, an optional adhesive layer, a charge generating layer, a charge transport layer, and an optional protective or overcoat layer. In particular, the supporting substrate is in the form of a drum.

The charge transport layer usually comprises, at a minimum, charge transporting molecules ("CTMs") dissolved in a polymer binder resin, the layer being substantially non-absorbing in a spectral region of intended use, for example, visible light, while also being active in that the injection of photogenerated charges from the charge generating layer can be accomplished. Further, the charge transport layer allows for the efficient transport of charges to the free surface of the transport layer.

When a charge is generated in the charge generating layer, it should be efficiently injected into the charge transport molecule in the charge transport layer. The charge should also be transported across the charge transport layer in a short time, more specifically in a time period shorter than the time duration between the exposing and developing steps in an imaging device. The transit time across the charge transport layer is determined by the charge carrier mobility in the charge transport layer. The charge carrier mobility is the velocity per unit field and has dimensions of $cm^2/V\cdot sec$. The charge carrier mobility is generally a function of the structure of the charge transport molecule, the concentration of the charge transport molecule in the charge transport layer, and the electrically "inactive" binder polymer in which the charge transport molecule is dispersed.

The charge carrier mobility must be high enough to move the charges injected into the charge transport layer during the exposure step across the charge transport layer during the time interval between the exposure step and the development step. To achieve maximum discharge or sensitivity for a fixed exposure, the photoinjected charges must transit the transport layer before the imagewise exposed region of the photoreceptor arrives at the development station. To the extent the carriers are still in transit when the exposed segment of the photoreceptor arrives at the development station, the discharge is reduced and hence the contrast potentials available for development are also reduced. The transit time of charges across the charge transport layer and charge carrier mobility are related to each other by the expression transit time=(transport layer thickness)$^2$/(mobility×applied voltage).

It is known in the art to increase the concentration of the charge transport molecule dissolved or molecularly dispersed in the binder to decrease the transit time. However, phase separation or crystallization sets an upper limit to the concentration of the transport molecules that can be dispersed in a binder. Increased concentration of charge transport molecule also decreases the mechanical strength of the layer, increasing wear and reducing the lifetime of the photoreceptor drum.

One charge transport molecule known in the art is N,N'-diphenyl-N,N'-bis(3-methylphenyl)-[1,1'-biphenyl]-4,4'-diamine (TPD). TPD has a zero-field mobility of about $1.38\times 10^{-6}$ $cm^2/V\cdot sec$ at a concentration of 40 weight percent in polycarbonate. Zero-field mobility $\mu_0$ is the mobility extrapolated down to vanishing fields, i.e., the field E in $\mu=\mu_0\cdot\exp(\beta\cdot E^{0.5})$ is set to zero. In general the field dependence expressed by $\beta$ is weak.

There continues to be a need for an improved photoreceptor drum having a charge transport layer with increased wear resistance to extend the intrinsic life of the photoreceptor device. Such an imaging member with increased transport mobility would allow for increases in the speed of imaging devices such as printers and copiers.

CROSS REFERENCE TO RELATED PATENTS AND APPLICATIONS

In U.S. Pat. No. 4,273,846, to Pai et al., the disclosure of which is fully incorporated herein by reference, an imaging member having a charge transport layer containing a terphenyl diamine is described.

U.S. Patent Publication No. 2002/0076632 to Yanus et al, filed Oct. 15, 2001, discloses aryldiamine charge transport molecules having more than 3 phenyl groups between the nitrogen atoms of the aryldiamine. This disclosure is also fully incorporated herein by reference.

U.S. Pat. No. 7,033,714; U.S. Pat. No. 7,005,222, to Horgan et al., issued Feb. 28, 2006; and U.S. Pat. No. 7,166,397, the disclosures of which are fully incorporated herein by reference, disclose a plurality of charge transport layers which may contain a substituted terphenyl diamine.

Reference is also made to copending, commonly assigned U.S. patent application Ser. No. 11/820,825 to Belknap et al., filed Jun. 21, 2007, entitled, "Imaging Member Having High Charge Mobility", the disclosure of which is incorporated by reference herein in their entirety.

SUMMARY

Disclosed herein, in various embodiments, are photoreceptor drums having a charge transport layer comprising a substituted terphenyl diamine. Also disclosed herein are methods of making such photoreceptor drums and methods of imaging utilizing them. The photoreceptor drums have improved wear resistance and allow for increased service lifetimes.

In a further embodiment, the photoreceptor drum has a charge generating layer and a charge transport layer comprising a polymer binder resin and a substituted terphenyl diamine.

These and other non-limiting features or characteristics of the present disclosure will be further described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
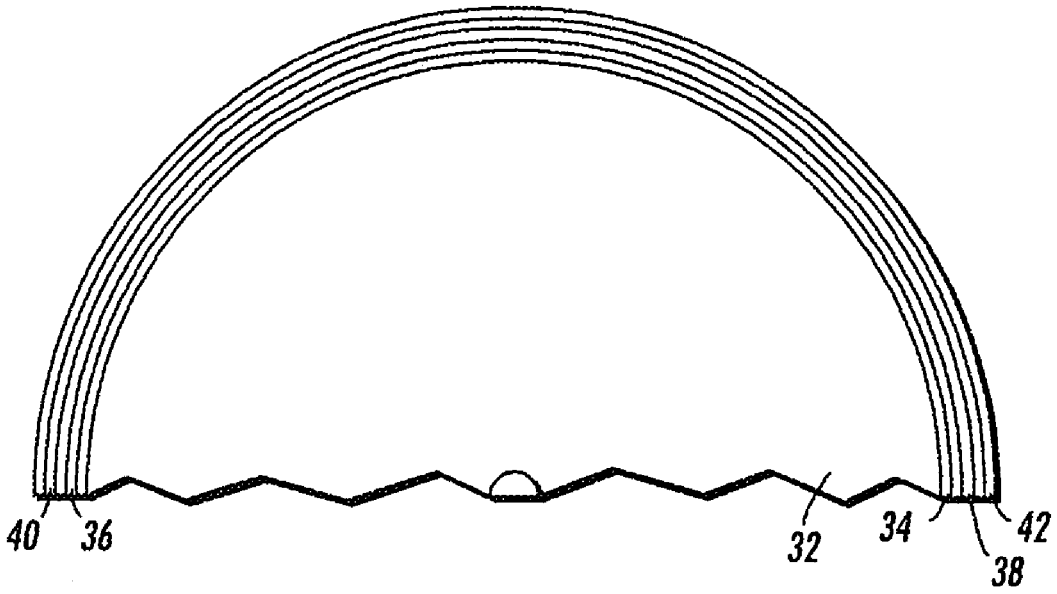
FIG. 1 is a cross-sectional view of an exemplary embodiment of a photoreceptor drum having a single charge transport layer.

The photoreceptor drums disclosed herein can be used in a number of different known imaging and printing processes including, for example, electrophotographic imaging processes, especially xerographic imaging and printing processes wherein charged latent images are rendered visible with toner compositions of an appropriate charge polarity. Moreover, the photoreceptor drums of this disclosure are also useful in color xerographic applications, particularly high-speed color copying and printing processes.

The exemplary embodiments of this disclosure are more particularly described below with reference to the drawings. Although specific terms are used in the following description for clarity, these terms are intended to refer only to the particular structure of the various embodiments selected for illustration in the drawings and not to define or limit the scope of the disclosure. The same reference numerals are used to identify the same structure in different Figures unless specified otherwise. The structures in the Figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

An exemplary embodiment of the photoreceptor drum of the present disclosure is illustrated in FIG. 1. The substrate 32 supports the other layers. An optional hole blocking layer 34 can also be applied, as well as an optional adhesive layer 36. The charge generating layer 38 is located between the optional adhesive layer 36 and the charge transport layer 40. An optional overcoat layer 42 may be placed upon the charge transport layer 40.

Figure 2:
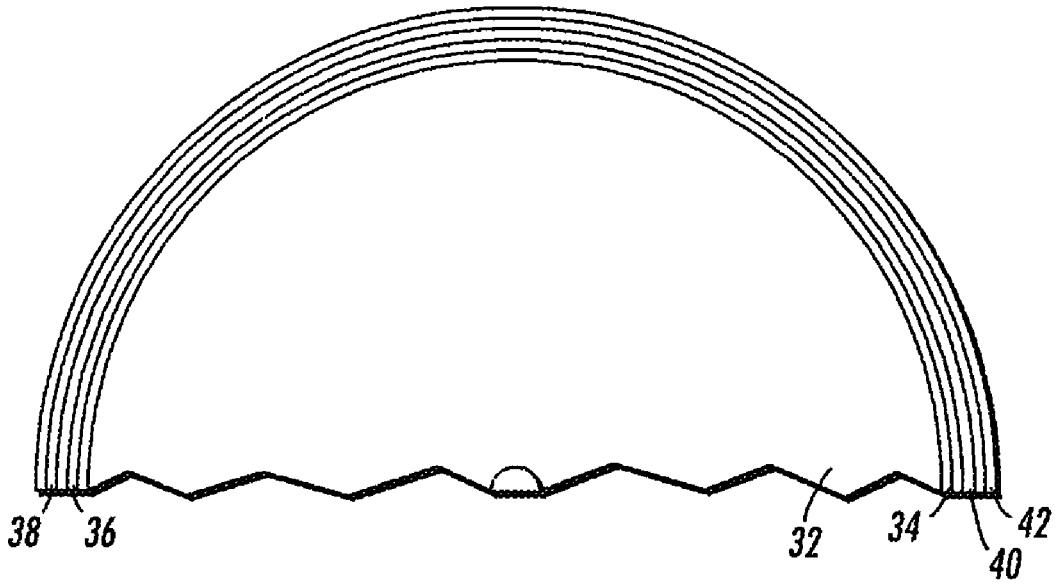
FIG. 2 is a cross-sectional view of another exemplary embodiment of a photoreceptor drum having a single charge transport layer.

Another exemplary embodiment of the photoreceptor drum of the present disclosure is illustrated in FIG. 2. This embodiment is similar to that of FIG. 1, except locations of the charge generating layer 38 and charge transport layer 40 are reversed. Generally, the charge generating layer, charge transport layer, and other layers may be applied in any suitable order to produce either positive or negative charging photoreceptor drums.

The charge transport layer 40 of FIG. 1 comprises certain specific charge transport materials which are capable of supporting the injection of photogenerated holes or electrons from the charge generating layer 38 and allowing their transport through the charge transport layer to selectively discharge the surface charge on the imaging member surface. The charge transport layer, in conjunction with the charge generating layer, should also be an insulator to the extent that an electrostatic charge placed on the charge transport layer is not conducted in the absence of illumination. It should also exhibit negligible, if any, discharge when exposed to a wavelength of light useful in xerography, e.g., about 4000 Angstroms to about 9000 Angstroms. This ensures that when the imaging member is exposed, most of the incident radiation is used in the charge generating layer beneath it to efficiently produce photogenerated charges.

The charge transport layer of the present disclosure comprises a substituted terphenyl diamine. These charge transport molecules have high mobility compared to conventional charge transport molecules like TPD. Because of their high mobility, they can be added in far lower concentrations, yet maintain the same performance. Because their concentration is lower, the polymer dilution of the charge transport layer is lessened and its mechanical strength is increased. This leads to reduced wear and longer service lifetimes.

The substituted terphenyl diamine of the present disclosure has the structure

Formula (I)

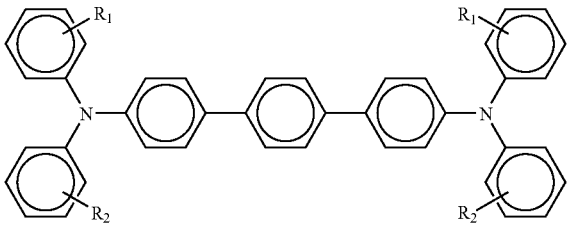

wherein $R_1$ and $R_2$ are independently selected from the group consisting of hydrogen, alkyl having from 1 to 10 carbon atoms, halogen, and phenyl; and wherein at least one of $R_1$ and $R_2$ is not hydrogen. In other embodiments, neither $R_1$, nor $R_2$ are hydrogen.

In a specific embodiment, the substituted terphenyl diamine of Formula (I) has the structure of Formula (II):

Formula (II)

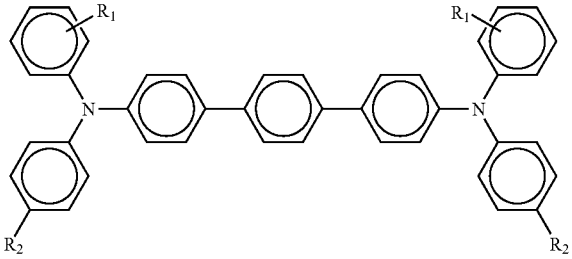

wherein $R_1$ is a methyl group in the ortho, meta, or para position and $R_2$ is a butyl group.

In a further specific embodiment, the substituted terphenyl diamine of Formula (I) is N,N'-bis(4-methylphenyl)-N,N'-bis[4-(n-butyl)phenyl]-[p-terphenyl]-4,4"-diamine, which has the structure of Formula (III):

Formula (III)

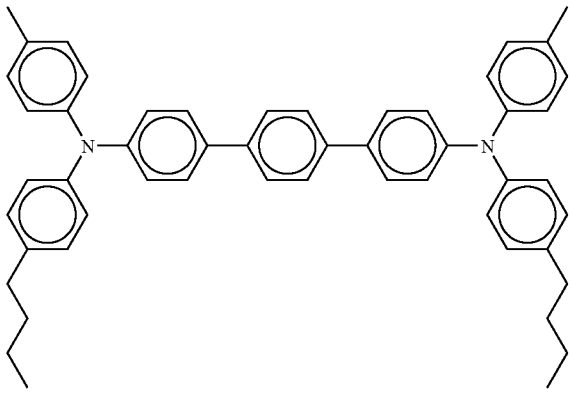

Alternatively, the substituted terphenyl diamine of the present disclosure has the structure of Formula (IV):

Formula (IV)

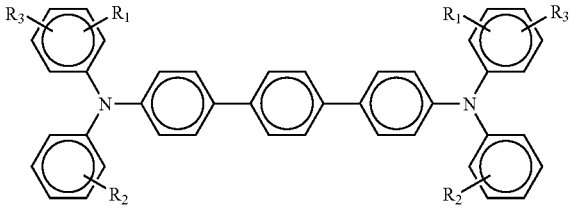

wherein $R_1$, $R_2$, and $R_3$ are independently selected from the group consisting of hydrogen, alkyl having from 1 to 10 carbon atoms, halogen, and phenyl; and wherein at least one of $R_1$, $R_2$, and $R_3$ is not hydrogen. In other embodiments, none of $R_1$, $R_2$, and $R_3$ are hydrogen. In another specific embodiment, $R_2$ is alkyl having from 1 to 10 carbon atoms.

In one specific embodiment, the substituted terphenyl diamine of Formula (IV) has the structure of Formula (V):

Formula (V)

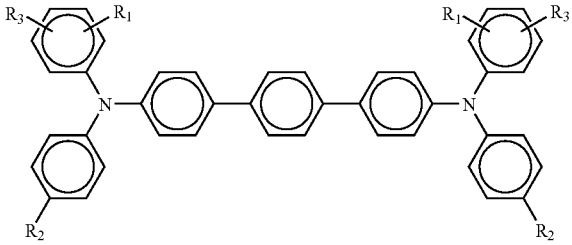

wherein $R_1$ and $R_3$ are methyl; and $R_2$ is alkyl having from 1 to 10 carbon atoms.

In another specific embodiment, the substituted terphenyl diamine of Formula (IV) has the structure of Formula (VI):

Formula (VI)

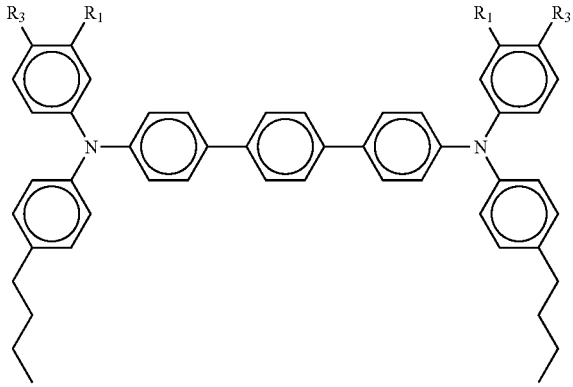

wherein $R_1$ and $R_3$ are methyl.

In a further specific embodiment, the substituted terphenyl diamine of Formula (IV) is N,N'-bis(3,4-dimethylphenyl)-N,N'-bis[4-(n-butyl)phenyl]-[p-terphenyl]-4,4"-diamine, which has the structure of Formula (VII):

Formula (VII)

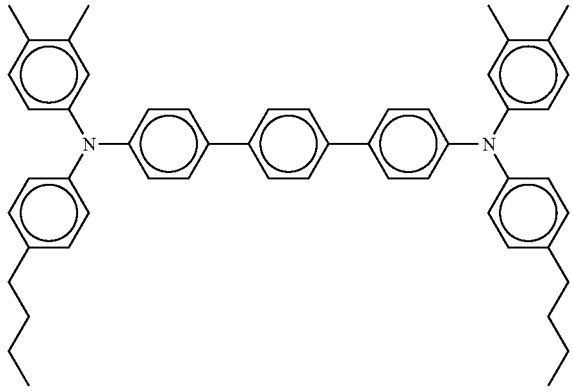

If desired, the charge transport layer may also comprise other charge transport molecules. For example, the charge transport layer may contain other triarylamines such as TPD, tri-p-tolylamine, 1,1-bis(4-di-[p-tolyl]aminophenyl)cyclohexane, and other similar triarylamines. Other suitable charge transport molecules include N,N,N',N'-tetra[4-methylphenyl]-[1,1'-biphenyl]-4,4'-diamine; and N,N-Bis[4-(4,4-diphenyl-1,3-butadienyl)phenyl]-phenylamine commercially available from Takasago. The additional charge transport molecules may, e.g., help minimize background voltage.

The charge transport layer also comprises a polymer binder resin in which the charge transport molecule(s) or component(s) is dispersed. The resin should be substantially soluble in a number of solvents, like methylene chloride or other solvent so that the charge transport layer can be coated onto the imaging member. Typical binder resins soluble in methylene chloride include polycarbonate resin, polyvinylcarbazole, polyester, polyarylate, polyacrylate, polyether, polysulfone, polystyrene, polyamide, and the like. Molecular weights of the binder resin can vary from, for example, about 20,000 to about 300,000, including about 150,000.

Polycarbonate resins having a weight average molecular weight Mw, of from about 20,000 to about 250,000 are suitable for use, and in embodiments from about 50,000 to about 120,000, may be used. The electrically inactive resin material may include poly(4,4'-dipropylidene-diphenylene carbonate) with a weight average molecular weight ($M_w$) of from about 35,000 to about 40,000, available as LEXAN 145 from General Electric Company; poly(4,4'-isopropylidene-diphenylene carbonate) with a molecular weight of from about 40,000 to about 45,000, available as LEXAN 141 from the General Electric Company; and a polycarbonate resin having a molecular weight of from about 20,000 to about 50,000 available as MERLON from Mobay Chemical Company. Resins known as PC-Z®, available from Mitsubishi Gas Chemical Corporation, may also be used. In specific embodiments, MAKROLON, available from Bayer Chemical Company, and having a molecular weight of from about 70,000 to about 200,000, is used. In other specific embodiments, PC-Z with a molecular weight of about 40,000 is used.

The charge transport layer of the present disclosure in embodiments comprises from about 20 weight percent to about 40 weight percent of the substituted terphenyl diamine and from about 60 weight percent to about 80 weight percent by weight of the polymer binder resin, both by total weight of the charge transport layer. In specific embodiments, the charge transport layer comprises from about 25 weight percent to about 35 weight percent of the substituted terphenyl diamine and from about 65 weight percent to about 75 weight percent of the polymer binder resin.

Generally, the charge transport layer for a photoreceptor drum can only be a single layer. Dual charge transport layers have little or no current application because even if useful, they would re-dissolve and mix during dip coating, the predominant method by which drums are coated. However, it may be possible for the charge transport layer to comprise dual or multiple layers and those embodiments are still contemplated. Generally, the bottom-most charge transport layer next to the charge generating layer would contain more substituted terphenyl diamine than the subsequent layers applied to it.

In embodiments having a single charge transport layer, the substituted terphenyl diamine is substantially homogenously dispersed throughout the polymer binder. The charge transport layer(s) may also be doped with polytetrafluoroethylene (PTFE) particles to increase wear resistance.

Generally, the thickness of the charge transport layer is from about 10 to about 100 micrometers, including from about 20 micrometers to about 60 micrometers, but thicknesses outside these ranges can also be used. In general, the ratio of the thickness of the charge transport layer to the charge generating layer is in embodiments from about 2:1 to 200:1 and in some instances from about 2:1 to about 400:1. In specific embodiments, the charge transport layer is from about 10 micrometers to about 40 micrometers thick.

Any suitable technique may be used to mix and apply the charge transport layer onto the charge generating layer. Generally, the components of the charge transport layer are mixed into an organic solvent to form a coating solution. Examples of organic solvents which may be used include aromatic hydrocarbons, aliphatic hydrocarbons, halogenated hydrocarbons, ethers, amides and the like, or mixtures thereof. In embodiments, a solvent such as cyclohexanone, cyclohexane, chlorobenzene, carbon tetrachloride, chloroform, methylene chloride, trichloroethylene, toluene, tetrahydrofuran, dioxane, dimethyl formamide, dimethyl acetamide and the like, may be utilized in various amounts. In a specific embodiment a mixture of THF and toluene in a 75:25 weight ratio is used. Typical application techniques include dip coating, ring coating, extrusion die coating, spraying, roll coating, wire wound rod coating, and the like. Drying of the coating solution may be effected by any suitable conventional technique such as oven drying, infra red radiation drying, air drying and the like. When the charge transport layer comprises dual or multiple layers, each layer is solution coated, then completely dried at elevated temperatures prior to the application of the next layer.

If desired, other known components may be added the charge transport layer. Such components may include antioxidants, such as a hindered phenol, leveling agents, surfactants, and light shock resisting or reducing agents. Particle dispersions may be added to increase the mechanical strength of the charge transport layer or provide light scattering capability in the charge transport layer as well.

The imaging member of the present disclosure may comprise a substrate 32, optional hole blocking layer 34, optional adhesive layer 36, charge generating layer 38, charge transport layer 40, and an optional overcoat layer 42. The remaining layers will now be described with reference to FIGS. 1 and 2.

The substrate support 32 provides support for all layers of the imaging member. It has the shape of a rigid drum and can have a diameter necessary for the imaging application it will be used for. It is generally made from a conductive material, such as aluminum, copper, brass, nickel, zinc, chromium, stainless steel, aluminum, semitransparent aluminum, steel, cadmium, silver, gold, zirconium, niobium, tantalum, vanadium, hafnium, titanium, nickel, chromium, tungsten, molybdenum, indium, tin, and metal oxides.

The optional hole blocking layer 34 forms an effective barrier to hole injection from the adjacent conductive layer into the charge generating layer. Examples of hole blocking layer materials include gamma amino propyl triethoxyl silane, zinc oxide, titanium oxide, silica, polyvinyl butyral, phenolic resins, and the like. Hole blocking layers of nitrogen containing siloxanes or nitrogen containing titanium compounds are disclosed, for example, in U.S. Pat. No. 4,291,110, U.S. Pat. No. 4,338,387, and U.S. Pat. No. 4,286,033, the disclosures of these patents being incorporated herein in their entirety. Similarly, illustrated in U.S. Pat. Nos. 6,255,027, 6,177,219, and 6,156,468, the entire disclosures of which are incorporated herein by reference, are photoreceptors containing a hole blocking layer of a plurality of light scattering particles dispersed in a resin. For instance, Example 1 of U.S. Pat. No. 6,156,468 discloses a hole blocking layer of titanium dioxide dispersed in a linear phenolic resin. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and more specifically have a thickness of from about 0.2 to about 25 micrometers.

An optional adhesive layer 36 may be applied to the hole blocking layer. Any suitable adhesive layer may be utilized. Any adhesive layer employed should be continuous and, more specifically, have a dry thickness from about 200 micrometers to about 900 micrometers and, even more specifically, from about 400 micrometers to about 700 micrometers. Any suitable solvent or solvent mixtures may be employed to form a coating solution for the adhesive layer. Typical solvents include tetrahydrofuran, toluene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited coating may be effected by any suitable conventional technique such as oven drying, infra red radiation drying, air drying, and the like.

Any suitable charge generating layer 38 may be applied which can thereafter be coated over with a contiguous charge transport layer. The charge generating layer generally comprises a charge generating material and a film-forming polymer binder resin. Charge generating materials such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof may be appropriate because of their sensitivity to white light. Vanadyl phthalocyanine, metal free phthalocyanine and tellurium alloys are also useful because these materials provide the additional benefit of being sensitive to infrared light. Other charge generating materials include quinacridones, dibromo anthanthrone pigments, benzimidazole perylene, substituted 2,4-diamino-triazines, polynuclear aromatic quinones, and the like. Benzimidazole perylene compositions are well known and described, for example, in U.S. Pat. No. 4,587,189, the entire disclosure thereof being incorporated herein by reference. Other suitable charge generating materials known in the art may also be utilized, if desired. The charge generating materials selected should be sensitive to activating radiation having a wavelength from about 600 to about 800 nm during the imagewise radiation exposure step in an electrophotographic imaging process to form an electrostatic latent image. In specific embodiments, the charge generating material is hydroxygallium phthalocyanine (OHGaPC), chlorogallium phthalocyanine (ClGaPc), or oxytitanium phthalocyanine (TiOPC).

Any suitable inactive film forming polymeric material may be employed as the binder in the charge generating layer 38, including those described, for example, in U.S. Pat. No. 3,121,006, the entire disclosure thereof being incorporated herein by reference. Typical organic polymer binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like.

The charge generating material can be present in the polymer binder composition in various amounts. Generally, from about 5 to about 90 percent by weight of the charge generating material is dispersed in about 10 to about 95 percent by weight of the polymer binder, and more specifically from about 20 to about 70 percent by weight of the charge generating material is dispersed in about 30 to about 80 percent by weight of the polymer binder.

The charge generating layer generally ranges in thickness of from about 0.1 micrometer to about 5 micrometers, and more specifically has a thickness of from about 0.3 micrometer to about 3 micrometers. The charge generating layer thickness is related to binder content. Higher polymer binder content compositions generally require thicker layers for charge generation. Thickness outside these ranges can be selected in order to provide sufficient charge generation.

An overcoat layer 42, if desired, may be utilized to provide imaging member surface protection as well as improve resistance to abrasion. Overcoat layers are known in the art. Generally, they serve a function of protecting the charge transport layer from mechanical wear and exposure to chemical contaminants.

The prepared photoreceptor drum may be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member of this disclosure. Thus, by applying a suitable electrical bias and selecting toner having the appropriate polarity of electrical charge, one may form a toner image in the charged areas or discharged areas on the imaging surface of the electrophotographic member of the present disclosure.

The imaging members of the present disclosure may be used in imaging. This method comprises generating an electrostatic latent image on the imaging member. The latent image is then developed and transferred to a suitable substrate, such as paper. Processes of imaging, especially xerographic imaging and printing, including digital, are also encompassed by the present disclosure. More specifically, the layered photoconductive imaging members of the present development can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are useful in color xerographic applications, particularly high-speed color copying and printing processes and which members are in embodiments sensitive in the wavelength region of, for example, from about 500 to about 900 nanometers, and in particular from about 650 to about 850 nanometers, thus diode lasers can be selected as the light source.

The present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

Preparation of Photoreceptor Drum

A photoreceptor drum is prepared by applying a charge blocking layer onto the rough surface of an aluminum drum having a diameter of 30 mm and a length of 40.4 cm. The zirconium silane blocking layer is applied by dip coating and the dried layer coating has a thickness of 1.15 micrometers. The drum is subsequently dip coated with a charge generation layer. The charge generation layer is either 1) 55 weight percent chlorogallium phthalocyanine dispersed in a matrix of 45 weight percent VMCH (available from Dow Chemical Co.) binder resin in a solvent mixture of n-butyl acetate and xylene in a 34:66 weight ratio; or 2) 60 weight percent hydroxygallium phthalocyanine type V dispersed in a matrix of 40 weight percent VMCH binder resin in n-butyl acetate solvent.

Example 1

A charge transport layer solution comprises N,N'-bis(4-methylphenyl)-N,N'-bis[4-(n-butyl)phenyl]-[p-terphenyl]-4,4"-diamine (p-MeTer) (3.85 grams), a polycarbonate PCZ-400 (poly(4,4'-dihydroxy-diphenyl-1-1-cyclohexane), $M_w$=40,000) available from Mitsubishi Gas Chemical Company, Ltd. (7.15 grams), 29.25 grams of tetrahydrofuran, and 9.75 grams of toluene. The solution is mixed, then applied directly over the charge generating layer of the photoreceptor drum. The charge transport layer is applied by a ring coating method and dried in a forced air oven at 135° C. for 40 minutes with the resulting dried layer having a thickness of about 30 micrometers. The resulting charge transport layer comprises 35% of the hole transport molecule p-MeTer.

Example 2

A photoreceptor drum is prepared according to Example 1, except the charge transport layer solution comprises N,N'-bis(4-methylphenyl)-N,N'-bis[4-(n-butyl)phenyl]-[p-terphenyl]-4,4"-diamine (p-MeTer) (2.46 grams), PCZ-400 (7.36 grams), 30.14 grams of tetrahydrofuran, and 10.05 grams of toluene. The resulting charge transport layer comprises 25% of the hole transport molecule p-MeTer.

Example 3

A photoreceptor drum is prepared according to Example 1, except the charge transport layer solution comprises N,N'-bis(3-methylphenyl)-N,N'-bis[4-(n-butyl)phenyl]-[p-terphenyl]-4,4"-diamine (m-MeTer) (3.85 grams), PCZ-400 (7.15 grams), 29.25 grams of tetrahydrofuran, and 9.75 grams of toluene. The resulting charge transport layer comprises 35% of the hole transport molecule m-MeTer.

Example 4

A photoreceptor drum is prepared according to Example 1, except the charge transport layer solution comprises N,N'-bis(3-methylphenyl)-N,N'-bis[4-(n-butyl)phenyl]-[p-terphenyl]-4,4"-diamine (m-MeTer) (2.46 grams), PCZ-400 (7.36 grams), 30.14 grams of tetrahydrofuran, and 10.05 grams of toluene. The resulting charge transport layer comprises 25% of the hole transport molecule m-MeTer.

Example 5

A photoreceptor drum is prepared according to Example 1, except the charge transport layer solution comprises N,N'-bis(4-tert-butylphenyl)-N,N'-bis[4-(n-butyl)phenyl]-[p-terphenyl]-4,4"-diamine (4-tBuTer) (3.85 grams), PCZ-400 (7.15 grams), 29.25 grams of tetrahydrofuran, and 9.75 grams of toluene. The resulting charge transport layer comprises 35% of the hole transport molecule 4-tBuTer.

Example 6

A photoreceptor drum is prepared according to Example 1, except the charge transport layer solution comprises N,N'-bis(4-tert-butylphenyl)-N,N'-bis[4-(n-butyl)phenyl]-[p-terphenyl]-4,4"-diamine (4-tBuTer) (2.46 grams), PCZ-400 (7.36 grams), 30.14 grams of tetrahydrofuran, and 10.05 grams of toluene. The resulting charge transport layer comprises 25% of the hole transport molecule 4-tBuTer.

Example 7

A photoreceptor drum is prepared according to Example 1, except the charge transport layer solution comprises N,N,N',N'-tetra[4-methylphenyl]-[1,1'-biphenyl]-4,4'-diamine (TMTPD) (3.85 grams), PCZ-400 (7.15 grams), 29.25 grams of tetrahydrofuran, and 9.75 grams of toluene. The resulting charge transport layer comprises 35% of the hole transport molecule TMTPD.

Example 8

A photoreceptor drum is prepared according to Example 1, except the charge transport layer solution comprises N,N,N',N'-tetra[4-methylphenyl]-[1,1'-biphenyl]-4,4'-diamine (TMTPD) (2.46 grams), PCZ-400 (7.36 grams), 30.14 grams of tetrahydrofuran, and 10.05 grams of toluene. The resulting charge transport layer comprises 25% of the hole transport molecule TMTPD.

Control Example 1

A photoreceptor drum is prepared according to Example 1, except the charge transport layer solution comprises TPD (3.85 grams), PCZ-400 (7.15 grams), 29.25 grams of tetrahydrofuran, and 9.75 grams of toluene. The resulting charge transport layer comprises 35% of the hole transport molecule TPD.

Control Example 2

A photoreceptor drum is prepared according to Example 1, except the charge transport layer solution comprises TPD (2.46 grams), PCZ-400 (7.36 grams), 30.14 grams of tetrahydrofuran, and 10.05 grams of toluene. The resulting charge transport layer comprises 25% of the hole transport molecule TPD.

Control Example 3

A photoreceptor drum is prepared according to Example 1, except the charge transport layer solution comprises TPD (3.93 grams), PCZ-400 (5.89 grams), 23.3 grams of tetrahydrofuran, and 7.8 grams of toluene. The resulting charge transport layer comprises 40% of the hole transport molecule TPD.

Testing

Test samples are placed in a wear test fixture designed to simulate the interaction of the photoreceptor drum with the various components of an imaging machine. The samples are exercised by cycling and their thickness is measured at various lateral and axial positions around the drum. The rate of material loss is calculated and expressed in nm/kilocycle. Examples 2, 3, 4, 5, and 6 had superior wear properties while maintaining excellent electrical response.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A photoreceptor drum comprising:

a substrate;

a charge generating layer disposed on the substrate; and a charge transport layer disposed on the charge generating layer, wherein the charge transport layer comprises a polymer binder resin, and a charge transport molecule wherein the charge transport molecule is N,N'-bis(4-tert-butylphenyl)-N,N'-bis[4-(n-butyl)phenyl]-[p-terphenyl]-4,4"-diamine, and further wherein the charge transport molecule is present in the charge transport layer in an amount of from about 25 weight percent to about 35 weight percent and the polymer binder resin is present in the charge transport layer in an amount of from about 65 weight percent to about 75 weight percent of the polymer binder resin.

2. The photoreceptor drum of claim 1, wherein the charge generating layer comprises metal phthalocyanine, metal free phthalocyannes, selenium, selenium alloys, hydroxygallium phthalocyanines, halogallium phthalocyanines, titanyl phthalocyanines or mixtures thereof.

3. The photoreceptor drum of claim 2, wherein the charge generating layer comprises a charge generating material selected from the group consisting of hydroxygallium phthalocyanine and oxytitanium phthalocyanine.

4. The photoreceptor drum of claim 1, wherein the binder is selected from the group consisting of polyesters, polyvinyl butyrals, polycarbonates, polystyrene, and polyvinyl formats.

5. The photoreceptor drum of claim 4, wherein the binder is a polycarbonate selected from the group consisting of poly (4,4'-isopropylidene diphenyl carbonate), poly(4,4'-diphenyl-1,1'-cyclohexane carbonate), or a polymer blend thereof.

6. The photoreceptor drum of claim 1, wherein the total thickness of the charge transport layer is from about 10 micrometers to about 100 micrometers.

7. The photoreceptor drum of claim 6, wherein the total thickness of the charge transport layer is from about 20 micrometers to about 60 micrometers.

8. The photoreceptor drum of claim 1, further comprising a rigid drum supporting substrate selected from the group consisting of aluminum, copper, brass, nickel, zinc, chromium, stainless steel, aluminum, semitransparent aluminum, steel, cadmium, silver, gold, zirconium, niobium, tantalum, vanadium, hafnium, titanium, nickel, chromium, tungsten, molybdenum, indium, tin, and metal oxides.

9. The photoreceptor drum of claim 1, further comprising an overcoat layer which is in contact with the charge transport layer.

10. A method of imaging, comprising:

generating an electrostatic latent image on a photoreceptor drum;

developing the latent image; and transferring the developed electrostatic image to a suitable substrate; wherein the photoreceptor drum has a charge transport layer comprising a polymer binder resin, a first charge transport molecule and a second charge transport molecule, the first charge transport molecule being selected from the group consisting of N,N'-bis(4-methylphenyl)-N,N'-bis[4-(n-butyl)phenyl]-[p-terphenyl]-4,4"-diamine and N,N'-bis(4-tert-butylphenyl)-N,N'-bis[4-(n-butyl)phenyl]-[p-terphenyl]-4,4"-diamine, the second charge transport molecule being selected from the group consisting of N,N'-diphenyl-N,N'-bis(3-methylphenyl)-[1,1'-biphenyl]-4,4'-diamine, N,N,N',N'-tetra[4-methylphenyl]-[1,1'-biphenyl]-4,4'-diamine, and N,N-Bis[4-(4,4-diphenyl-1,3-butadienyl)phenyl]-phenylamine, and further wherein the charge transport molecules are present in the charge transport layer in an amount of from about 25 weight percent to about 35 weight percent and the polymer binder resin is present in the charge transport layer in an amount of from about 65 weight percent to about 75 weight percent of the polymer binder resin.

* * * * *